United States Patent [19]

Wandl

[11] 4,135,638

[45] Jan. 23, 1979

[54] SPRAY CAN SAFETY CAP

[75] Inventor: Rudolf H. Wandl, Binau, Fed. Rep. of Germany

[73] Assignee: Kurt Vogelsang GmbH, Fed. Rep. of Germany

[21] Appl. No.: 897,696

[22] Filed: Apr. 19, 1978

[30] Foreign Application Priority Data

Apr. 22, 1977 [DE] Fed. Rep. of Germany ... 7712650[U]

[51] Int. Cl.[2] ..... B65D 43/26

[52] U.S. Cl. ..... 220/284; 220/85 P; 222/182

[58] Field of Search ..... 220/284, 85 P; 222/182

[56] References Cited

U.S. PATENT DOCUMENTS

| | | | |
|---|---|---|---|
| 3,235,131 | 2/1966 | Lerner | 222/182 |
| 3,532,249 | 5/1969 | Gach | 222/284 |
| 3,804,286 | 4/1974 | Watson et al. | 220/85 P |

*Primary Examiner*—George T. Hall

*Attorney, Agent, or Firm*—Craig & Antonelli

[57] ABSTRACT

A safety cap for spray cans with the cap including an inner slotted cap part and an outer cap part surrounding the inner slotted cap part and being provided with a window located radially opposite a slot of the inner slotted cap part. A stop or limiting device is provided behind the slot of the inner slotted cap part for preventing a tool inserted through the window from contacting a valve body of the spray can.

14 Claims, 3 Drawing Figures

SPRAY CAN SAFETY CAP

The present invention relates to a cap construction and, more particularly, to a safety cap for an aerosol or spray can such as, for example, a paint spray can, with the safety cap including an inner slotted cap part and an outer cap part with the inner slotted cap part having a lower edge fitting beneath an edge of a dome supporting a valve body and with the outer cap part surrounding the inner cap part with a space therebetween and having a window located radially opposite the slot in the inner cap part, through which window the slot in the inner cap part is accessible and spreadable.

Safety caps of the afore-mentioned type, normally called "double caps" have been proposed, for example, in German Utility Model No. 75 31 271. Advantages of the so-called "double caps" reside in the fact that not only is considerable stability realized, but also a "guaranteed seal" results with simple means, whereby the safety cap cannot be removed without removing the original packing for this purpose. Specifically, the sealing edge of the inner cap part which fits beneath the edge of the dome of the spray can secures the safety cap to the spray can until the "guaranteed seal" is broken from outside of the can by insertion of an implement or tool such as, for example, a screwdriver, through the window of the outer cap part, with the screwdriver serving to widen the inner cap part so that the safety cap is then removable.

One disadvantage of the proposed double safety caps resides in the fact that, depending upon the size of the tool or implement used to open the safety cap, the valve body or seal itself may be contacted and/or actuated when the tool is inserted so that the valve seal is damaged and/or the material contained in the can is sprayed in an undesirable manner. Additionally, it has been found that the window opening in the outer cap part can either be too large to permit use of small tools, or too small to allow large tools to pass therethrough.

The aim underlying the present invention essentially resides in providing a safety cap that can be removed with merely any elongated tool.

According to one advantageous feature of the present invention, a stop or limiting means is arranged behind a slot of the inner slotted part of the safety cap with the stop or limiting means being displaced radially with respect to the center of the safety cap and in front of the valve body of the spray can. By virtue of this arrangement, it is possible, in a very simple fashion, to prevent a tool, inserted from outside of the safety cap, from contacting the valve body so as to actuate and/or damage the same.

According to another advantageous feature of the present invention, a window means for permitting access to the inner slotted cap part is arranged in the outer cap part with the window means having an approximately circular opening divided into at least three smaller openings by at least two vertical strips. By virtue of this construction, it is possible to use even small, narrow tools such as, for example, screwdrivers, for opening the safety cap with the narrow tools being insertable through a central elongated opening formed between the vertical strips. Upon insertion of the narrow tool in the elongated opening, the tool can abut the vertical strips so that excellent guidance of the tool is achieved. If larger tools are utilized, it will suffice to insert the larger tool in a similar fashion initially between the vertical strips in the central elongated opening with the strips subsequently being broken away by the larger tool so that the larger tool can then be inserted into the slot in the inner slotted cap part to spread the latter and break the seal between the safety cap and the spray or aerosol can.

In accordance with yet further features of the present invention, the stop or limiting means can be simply manufactured as a tongue running parallel to the slot of the inner slotted cap part with the tongue being capable of being injection-molded integrally with the safety cap in a simple fashion. Moreover, the safety cap is capable of being manufactured from a plastic material that allows a paint to adhere to the surface thereof.

In accordance with the present invention, the tongue may be disposed at a distance from a wall of the inner slotted cap part and be mounted exclusively on an inner surface of an upper side of the safety cap so that the manufacture of the safety cap is effected in a very simple manner with tools employed to make previously proposed safety caps.

According to yet another feature of the present invention, the inner cap part can be provided with at least one additional slot located diametrically opposite the first slot with the second slot dividing the wall of the inner cap part into two semi-cylindrical shells. By virtue of the construction of the inner cap part so as to be multislotted, not only is a desired reliable seat for the cap ensured, but also an easier spreading of the sealing ring provided on the lower edge of the inner cap part is made possible.

Accordingly, it is an object of the present invention to provide a safety cap for a spray or aerosol can which avoids, by simple means, the drawbacks and disadvantages encountered in the prior art.

Another object of the present invention resides in providing a safety cap for a spray or aerosol can which is simple in construction and, therefore, inexpensive to manufacture.

A further object of the present invention resides in providing a safety cap for a spray or aerosol can which minimizes, if not avoids, inadvertent actuation and/or damage to a valve body of the spray can.

An additional object of the present invention resides in providing a safety cap for a spray or aerosol can whereby the breaking of the seal between the can and safety cap is greatly facilitated.

These and other objects, features and advantages of the present invention will become more apparent from the following description when taken in connection with the accompanying drawings which show, for the purposes of illustration only, one embodiment in accordance with the present invention, and wherein.

Figure 1:
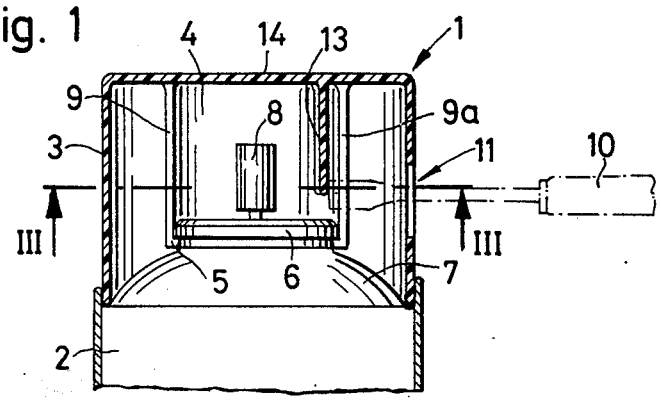
FIG. 1 is a partial, somewhat schematic, longitudinal cross-sectional view through a double safety cap in accordance with the present invention.

Referring now to the drawings wherein like reference numerals are used throughout the various views to designate like parts and, more particularly, to FIG. 1, a safety cap generally designated by the reference numeral 1 is mounted on an aerosol or spray can 2 such as, for example, a paint spray can, with the safety cap 1 being constructed as a "double cap" and including an outer cap part 3 and an inner cap part 4 disposed concentrically inside the outer cap part 3. The inner cap part 4 includes a lower edge 5 which is arranged as a sealing part and fits beneath an edge 6 of a dome 7 of the aerosol or spray can 2 with a valve body or seal 8 being disposed on the dome 7.

Figure 2:
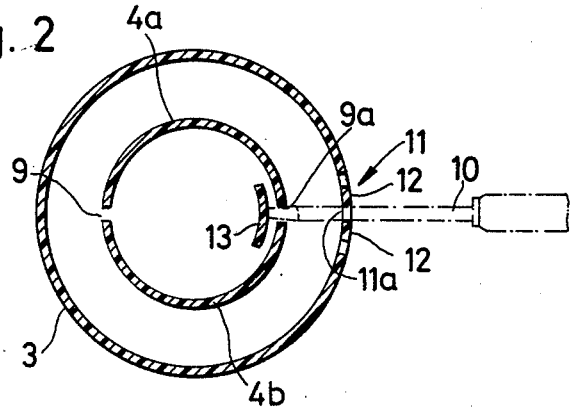
FIG. 2 is a cross-sectional view taken along the line II—II in FIG. 1.

As shown particularly in FIG. 2, the inner cap 4 is divided by two continuous longitudinally extending slots 9, 9*a* into two semi-cylindrical shells 4*a*, 4*b* with the shells 4*a*, 4*b* being spreadable away from one another by the introduction of a suitable tool 10, shown in phantom line, so that the lower edge 5 separates from the edge 6 and permits the safety cap 1 to be removed.

Figure 3:
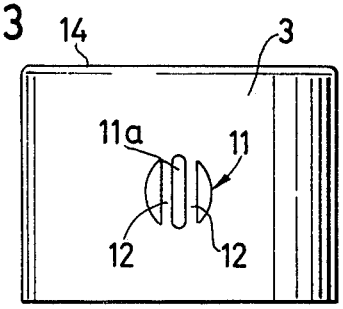
FIG. 3 is a side view of the double safety cap of FIGS. 1 and 2.

For the purpose of permitting entry of the tool 10 and separation of the lower edge 5 from the edge 6, a window generally designated by the reference numeral 11 is provided in the outer cap part 3 with the window having an approximately circular configuration and, as shown most clearly in FIG. 3, divided into three openings by two vertical strips 12 with the middle or central opening 11*a* having an elongated cross-section. The opening 11*a* is located radially opposite the first slot 9*a* in the inner cap part 4.

As shown in FIGS. 1 and 2, a stop or limiting means in the form of a tongue 13 is provided and extends downwardly from an inner surface of an upper side 14 of the safety cap 1. The tongue 13 is an extension of a radius drawn from the opening 11*a* through the slot 9*a*. The tongue 13 is fastened exclusively to the inner surface of the upper side 14 of the safety cap 1 and extends in parallel to the slot 9*a*. The tongue 13 extends in front of the valve seal or body 8 and acts as a stop or limiting means for preventing the tool 10 from being inserted to a depth at which the tool 10 could contact the valve seal or body 8 and cause actuation and/or damage to the valve seal or body 8.

In the illustrated embodiment, the tongue 13 is made integral with the entire safety cap 1, with the safety cap 1 being manufactured from an acrylic butadiene styrene plastic, known under the name of Novodur 3 CN. If the safety cap 1 is utilized on a spray paint can, the manufacturing of the safety cap 1 of the noted material has the advantage that the entire outer surface of the safety cap 1 can be provided with a paint coating which matches the paint contained in the spray or aerosol can 2. It has been found that this plastic alone allows the paint to adhere sufficiently well. Previously, it was only possible to apply a paint coating to metal caps since a paint contained in a spray or aerosol can 2, normally used exclusively for touching-up motor vehicles, is intended by its very nature for adhesion to metals. Despite the use of a plastic cap and the more economic manufacture which can be achieved thereby, the safety cap 1 according to the present invention, together with the spray or aerosol can 2, is very well suited for making color comparisons with other color structures without having to remove the safety cap 1. It is also possible to cover the outer window 11 with a film which must be removed before the safety cap 1 is removed in order to insert a tool 10 so as to produce a guaranteed seal.

The construction of the window 11 in the manner proposed herein has the advantage that smaller screwdrivers and/or other thin tools can be easily inserted into the opening 11*a* between the two vertical strips 12 and then guided bilaterally for the necessary rotation. If larger tools are to be introduced, it is possible, after introduction of one end of the larger tool in the opening 11*a*, to break loose the two vertical strips 12. For this purpose, in a manner not shown in detail, the vertical strips 12 may be provided with predetermined breakaway points at upper and lower ends thereof, whereby the entire approximately circular opening of the window 11 would then be available for insertion of a tool 10.

While I have shown and described only one embodiment in accordance with the present invention, it is understood that the same is not limited thereto, but is susceptible of numerous changes and modifications as known to one having ordinary skill in the art, and I therefor do not wish to be restricted to the details shown and described herein, but intend to cover all such modifications as are encompassed by the scope of the appended claims.

I claim:

1. A safety cap for spray cans, the safety cap comprising an inner and outer cap part, the inner cap part being provided with at least one longitudinally extending slot and a lower edge adapted to fit beneath an edge of a dome supporting a valve body of the spray can, the outer cap part surrounding the inner cap part with a space therebetween and being provided with a window means arranged radially opposite the at least one slot of the inner cap part for permitting access to and spreading of the at least one slot, characterized in that a stop means, radially displaced relative to a center of the safety cap, is disposed between the at least one slot and the valve body for preventing a tool inserted through the window means from contacting the valve body.

2. A safety cap according to claim 1, characterized in that the window means has an approximately circular configuration, and in that strips are arranged in the window means so as to divide the same into three smaller openings.

3. A safety cap according to claim 2, characterized in that a middle opening of the three smaller openings has an elongated cross-section.

4. A safety cap according to claim 3, characterized in that the stop means is constructed as a tongue disposed in parallel to the at least one slot.

5. A safety cap according to claim 4, characterized in that the tongue is disposed at a predetermined distance from a wall of the inner cap part and abuts an inner surface of an upper side of the safety cap.

6. A safety cap according to claim 5, characterized in that the inner cap part includes at least one additional slot located diametrically opposite the first-mentioned slot, the slots dividing the wall of the inner cap part into two semi-cylindrical shells.

7. A safety cap according to claim 6, characterized in that the inner cap part and the outer cap part are made of an acrylic butadiene styrene.

8. A safety cap according to claim 1, characterized in that the stop means is constructed as a tongue disposed in parallel to the at least one slot.

9. A safety cap according to claim 8, characterized in that the tongue is disposed at a predetermined distance from a wall of the inner cap part and abuts an inner surface of an upper side of the safety cap.

10. A safety cap according to claim 9, characterized in that the inner cap part includes at least one additional slot located diametrically opposite the first-mentioned slot, the slots dividing the wall of the inner cap part into two semi-cylindrical shells.

11. A safety cap according to claim 10, characterized in that the inner cap part and the outer cap part are made of an acrylic butadiene styrene.

12. A safety cap according to claim 1, characterized in that the inner cap part includes at least one additional slot located diametrically opposite the first-mentioned slot, the slots dividing the wall of the inner cap part into two semi-cylindrical shells.

13. A safety cap according to claim 12, characterized in that the inner cap part and the outer cap part are made of an acrylic butadiene styrene.

14. A safety cap according to claim 1, characterized in the the inner cap part and the outer cap part are made of an acrylic butadiene styrene.

* * * * *